United States Patent [19]

Hollingsworth

[11] Patent Number: 4,575,991

[45] Date of Patent: Mar. 18, 1986

[54] SKIN PACKAGING MACHINE WITH VACUUM FRAME

[75] Inventor: Alexander Hollingsworth, Anderson, S.C.

[73] Assignee: Nordson Corporation, Amherst, Ohio

[21] Appl. No.: 660,109

[22] Filed: Oct. 12, 1984

[51] Int. Cl.[4] ..... B65B 11/52

[52] U.S. Cl. ..... 53/509; 53/141; 53/427

[58] Field of Search ..... 53/427, 441, 509, 510, 53/556, 218, 221, 464, 141

[56] References Cited

U.S. PATENT DOCUMENTS

| | | | |
|---|---|---|---|
| 2,991,600 | 7/1961 | Lancaster | 53/427 |
| 3,377,770 | 4/1968 | Rorer | 53/509 |
| 3,449,886 | 6/1969 | Connelly et al. | 53/509 |
| 3,501,886 | 3/1970 | Watts et al. | 53/509 |
| 3,512,335 | 5/1970 | Rorer | 53/509 |
| 4,077,184 | 3/1978 | Kremer et al. | 53/509 |
| 4,418,511 | 12/1983 | Collin | 53/509 |

*Primary Examiner*—John Sipos
*Assistant Examiner*—Donald R. Studebaker
*Attorney, Agent, or Firm*—Wood, Herron & Evans

[57] ABSTRACT

A skin packaging machine having a vacuum box, an oven spaced above the vacuum box, a film frame movable between the vacuum box and the oven, and a source of film. The film frame is hollow and is connected to a source of vacuum. Holes are formed around the upper surface of the film frame to hold the film to the frame during the packaging operation.

6 Claims, 3 Drawing Figures

SKIN PACKAGING MACHINE WITH VACUUM FRAME

This invention relates to a skin packaging machine and more particularly, the invention relates to a film frame for the skin packaging machine.

A skin packaging machine is an apparatus for drawing a heated film, by vacuum, down onto a substrate such as paperboard, the substrate having one or more articles to be packaged placed upon it. Conventionally, a skin packaging machine includes a vacuum box having a perforated platen forming a horizontal surface onto which the substrate is placed. An oven is spaced above the vacuum box. A film frame is movable between a position adjacent to the vacuum box and a position adjacent the oven. A film supply roll is located along side the vacuum box.

The film is placed in the film frame when the frame is in a lowered position. The frame is then raised to bring the film into a position adjacent the oven where the film is heated until it becomes "droopy." Meanwhile, the operator places a substrate with the articles to be packaged on top of the vacuum box. The film frame is then lowered to bring the heated film into position overlying the substrate and articles. Thereafter the vacuum is drawn on the vacuum box to pull the film tightly down onto the substrate and around the article to be packaged. The film will adhesively join to the substrate thereby forming the package. The operator then slides the package off the vacuum box, this operation drawing a fresh supply of film into the film frame. This film is transversely severed adjacent the package and the sequence of operations is repeated.

The original film frames consisted of a pair of pivoted jaws which were opened as the new film was drawn into the frame and were thereafter closed. Such a film frame has the disadvantages of requiring separate manipulative steps to open and close the jaws. The upper jaw would space the film from the oven and would thereby prevent the film from being brought immediately adjacent to the oven. Further, the upper jaw formed a heat sink absorbing the heat from the oven around the perimeter of the film. Thus, the center portion of the film would be heated to a greater extent than the perimeter of the film.

A recent improvement has been made in film frames. Instead of the two-jaw film frame, a hollow rectangular frame is formed with apertures on the lower surface of the frame and suction cups in the apertures. A vacuum is applied to the frame when the film has been drawn underneath it, the vacuum and suction cups causing the film to be clamped to the undersurface of the frame.

This vacuum frame design still has some of the disadvantages of the two-jaw frame. The frame is still between the oven and the film and hence spaces the film away from the oven and acts as a heat sink preventing the uniform heating of the film. Further, the frame must be lifted in order to remove the completed package.

The objective of the present invention has been to improve upon the prior art vacuum frame by eliminating the disadvantages referred to above.

This objective of the invention is attained by providing a hollow frame connected to a vacuum source. Holes are spaced around the upper surface of the frame and ventilator plugs are placed in the holes. Ventilator plugs are a known article which is hollow and has a screening on its upper end, the screening preventing the film from being extruded into the holes in the frame when the film is subjected to heat and vacuum.

A vacuum box below the film frame has slightly smaller external dimensions than the inside dimensions of the film frame so that when the film frame is lowered, it surrounds the vacuum box with the vacuum box projecting slightly above the upper surface of the film frame.

Among the advantages of the present invention are the following:

By placing the vacuum holes on the upper surface of the film frame and by raising the vacuum box to project slightly above the surface of the film frame, the article to be packaged and its substrate are above the level of the film frame. Thus when the packaging operation is completed, the package can be slid off the film frame without requiring it to be raised. The operation is thus simplified.

Further, by having the vacuum holes on the upper surface of the film frame, the film can be brought immediately adjacent the oven rather than being spaced from it by the thickness of the film frame. Still further, the oven is provided with a downward-facing gasket around its perimeter. The film frame will seat against the gasket when the film frame is raised to a position adjacent to the oven and thus confines all of the heat of the oven for direct application to the film. This feature of the invention introduces a substantial savings in the energy required to heat the oven as well as a reduction in cycle time. Further, it permits the energizing of the oven only during the time that the film frame is seated against the oven gasket. Further, since the film frame is on the side of the film remote from the oven, the heat sink effect is eliminated or substantially minimized.

Another feature of the invention consists of the provision of a roller mounted alongside the film frame adjacent the supply roll of film. The roller provides a space between the roller and the film frame through which supply of film may be passed.

Further, another feature of the invention consists of the positioning of a hot wire on the opposite side of the film frame from the roller. The hot wire functions to sever the film at the package after the package has been formed and removed from the vacuum box. More specifically, the package is slid to a position alongside the film frame, the film frame is raised about $\frac{1}{2}$ to 1 inch which pulls the film against the hot wire effecting the severing of the film.

The several features and objectives of the invention will become more readily apparent from the following detailed description taken in conjunction with the accompanying drawings in which.

Figure 1:
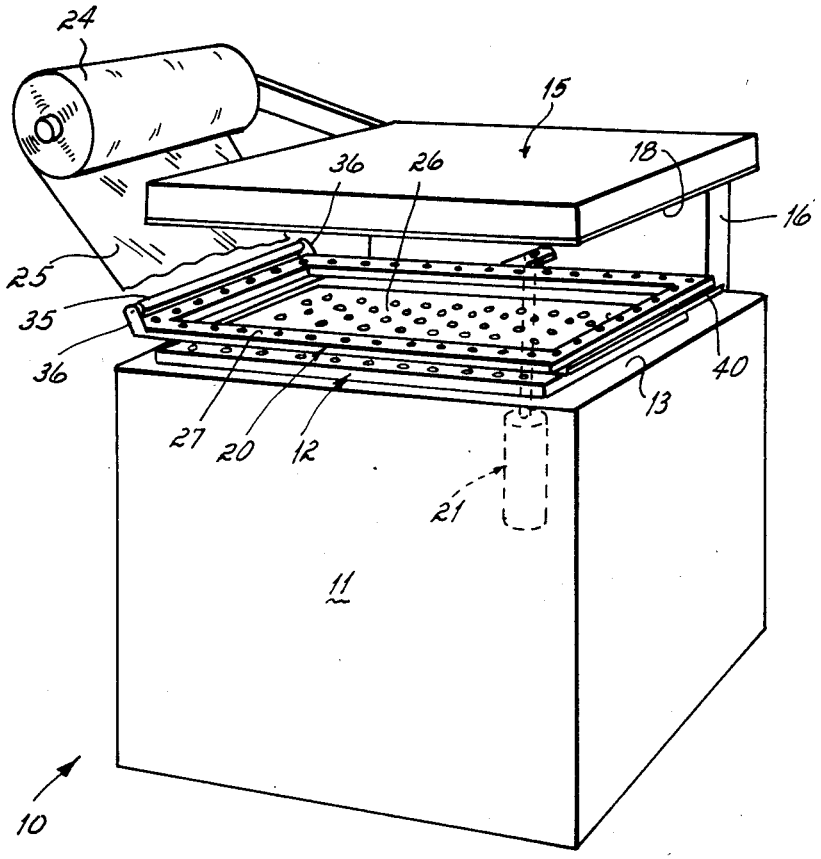
FIG. 1 is a diagrammatic perspective view of the invention.

Referring to FIG. 1, the skin packaging machine is indicated at 10 and has a base 11 on which the operating elements are mounted. Supported on the base is a vacuum box 12 which projects about $1\frac{3}{4}$ inch above an upper surface 13 of the base.

An oven 15 is supported by a post 16 above the base 11 and is vertically adjustable. The oven has heaters 17 (FIG. 2) within it which direct their heat downwardly. A gasket 18 is mounted around the perimeter of the oven against which a film frame will seat while the film is being heated. A film frame 20 is located between the oven 15 and the vacuum box 12. It is cantilevered from the post 16 and is slidable on linear bearings, not shown. A pneumatic cylinder 21 is connected between the base and the film frame for raising and lowering the film frame between a position surrounding the vacuum box 12 and a position adjacent the lower surface of the oven 15. A supply role 24 of film 25 is mounted adjacent the oven.

Figure 2:
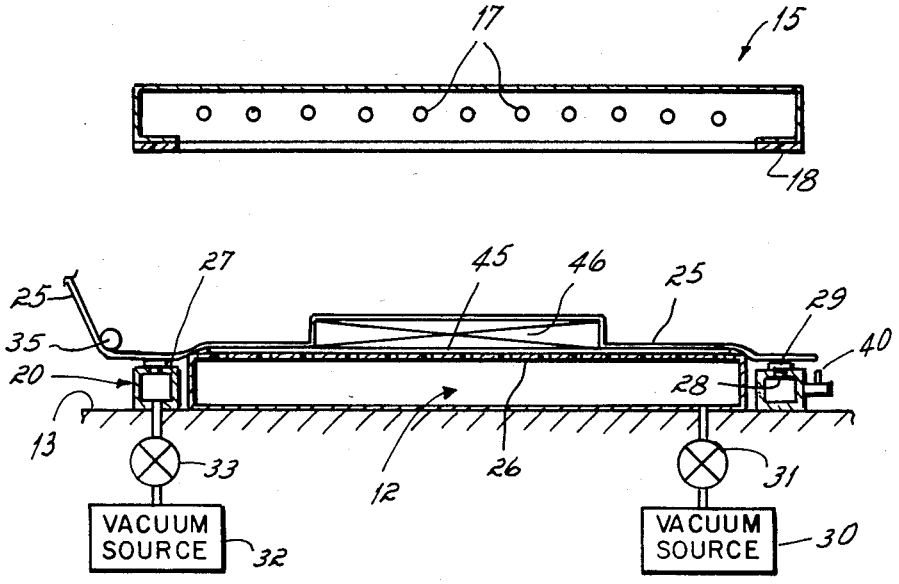
FIG. 2 is a cross-sectional view taken along lines 2—2 of FIG. 1 showing the film frame in a lowered position.

As best seen by reference to FIG. 1 and 2, the film frame is rectangular, having inside dimensions slightly greater than the corresponding outside dimensions of the vacuum box so that when in a lowered position, as shown in FIG. 2, the film frame surrounds the vacuum box. The film frame has a vertical dimension of $1\frac{1}{2}$ inches so that when it is in its lower position on the surface 13 of the base, the vacuum box projects about $\frac{1}{4}$ inch above the upper surface of the film frame. The upper surface of the vacuum box includes a perforated or foraminous platen 26 through which a vacuum is drawn to pull the film against the substrate 45 (to be discussed) placed on it. The vacuum box has a separate source of vacuum 30 having an on/off valve 31 as diagrammatically shown in FIG. 2.

The film frame has an upper surface 27. A series of holes 28 are spaced around the upper surface of a frame 20. Ventilator plugs 29 are inserted in the holes to provide a screening covering each of the holes, the screening preventing the film from being extruded through the holes when the film is heated and vacuum is applied. The frame 20 is connected to a vacuum source 32 having an on/off valve 33 as diagrammatically shown in the drawings.

At the left side of the film frame as viewed in FIG. 2, a roller 25 is mounted by brackets 36 to the film frame 20. As shown in FIG. 2, the film 25 passes under the roller 35 and normally lies across the film frame, being held to the film frame by vacuum applied to the holes 28.

A hot wire 40 is mounted on the right side of the film frame as viewed in FIG. 2, the hot wire being provided to cut the film from a completed package after the package has been removed from the vacuum box.

The machine 10 is provided with automatic controls which operate the vacuum valves and raise and lower the film frame and apply energy to the oven, all as described in the following sequence of operations.

Figure 3:
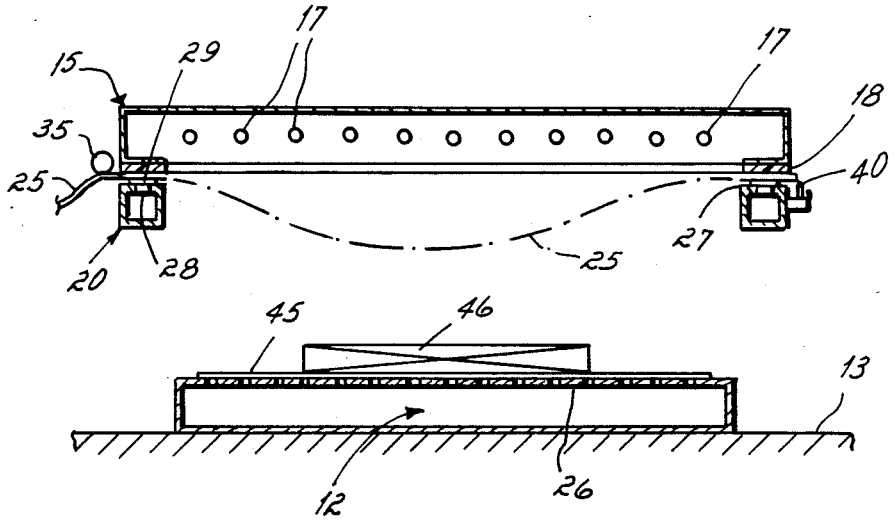
FIG. 3 is a cross-sectional view similar to FIG. 2 showing the frame in an elevated position adjacent the oven.

In the operation of the invention, let it be assumed a substrate 45 and articles 46 to be packaged have been placed on the vacuum box platen, that the film has been drawn across the frame 20 and the frame has been raised to a position adjacent to the oven as shown in FIG. 3. In this position, the frame 20 seats against oven gasket 18. The heaters 17 are energized briefly until the film carried by the frame attains a droopy condition.

In the raised position, it can be seen that the frame 20 is on the side of the film remote from the oven and hence does not act as a heat sink tending to cause a non-uniform heating of the film. Further, it can be seen that the film is brought against the oven gasket thereby confining the heat only to the film. When the film becomes droopy, as indicated by the phantom lines in FIG. 3, the film is ready for application to the substrate. The film frame is then lowered to the position shown in FIG. 2.

As can be seen from FIG. 2, the film frame surrounds the upwardly-projecting vacuum box and lowers the film down around the substrate 45 and the article 46 to be packaged. A vacuum from the source 30 is then applied to draw the film tightly against the substrate where the combination of the surface of the substrate and the tacky film causes the film to adhere to the substrate.

When the film has adhered to the substrate, the vacuum to the vacuum box and the film frame is removed. The operator then draws the package toward the right as viewed in FIG. 2 causing a fresh supply of film passing under the roller 35 to be brought across the frame 20. As soon as the fresh supply of film has been brought across the frame, the vacuum from the source 32 is reapplied. At this point the film frame may be raised one-half to one inch, causing the hot knife 40 to be raised against the film and to sever it from the package.

The film frame is then raised about 5 inches above the vacuum box, permitting the operator to position a new substrate and article on the foraminous platen. While the frame is in this intermediate position, residual heat of the oven begins to soften the film, thereby further reducing the time and energy required to heat the film. The film frame is then raised against the oven as before and the cycle of operations is repeated.

The film frame is then raised to a position adjacent the oven as shown in FIG. 3 and the sequence of operation is repeated.

Having described my invention, I claim:

1. In a skin packaging machine having a base, a vacuum box having a perforated platen onto which a substrate and articles to be packages are placed, vacuum means for applying a vacuum to said vacuum box, an oven mounted to said base and overlying said vacuum box and a support for a roll of film adjacent said base, the improvement comprising a film frame surrounding said perforated platen and mounted between said platen and said oven, said frame being hollow and having a plurality of holes in its upper surface and spaced around said frame, means for applying a vacuum to said frame sufficient to hold said film on said upper surface by said holes on said frame, and means for moving said frame between a position adjacent said platen and a position adjacent said oven so that said film on said upper surface juxtaposes said oven without any interposed elements.

2. Apparatus as in claim 1 in which said vacuum box projects slightly above the upper surface of said film frame when said film frame is in its lower position adjacent said vacuum box.

3. Apparatus as in claim 1 in which said holes in said film frame have ventilator plugs inserted in them to prevent film from being drawn into said holes when vacuum is applied to the frame.

4. Apparatus as in claim 1 further comprising, a roller mounted on one side of said film frame adjacent said film supply, said film passing between said roller and said frame.

5. Apparatus as in claim 1 further comprising, a hot wire knife mounted across the side of said film frame remote from the film supply for severing said film from a completed package.

6. Apparatus as in claim 1 in which said oven has a gasket around its perimeter, said frame moving means raising said frame into a position seated on said gasket when said film is to be heated by said oven.

* * * * *

UNITED STATES PATENT AND TRADEMARK OFFICE

CERTIFICATE OF CORRECTION

PATENT NO. : 4,575,991 Page 1 of 2

DATED : March 18, 1986

INVENTOR(S) : Alexander Hollingsworth

It is certified that error appears in the above-identified patent and that said Letters Patent is hereby corrected as shown below:

Column 1, line 26, delete "Thereafter" and insert -- Simultaneously --

Column 2, line 30, 31, 32, delete "Further, it permits the energizing of the oven only during the time that the film frame is seated against the oven gasket."

Column 3, line 24, delete "valve" and insert -- switch --

Column 3, line 32, delete "valve" and insert -- switch --

Column 3, line 45, after "the," insert -- switches to the --

Column 3, line 45, delete "valves" and insert -- sources --

Column 3, line 54, after "briefly" insert -- . --

Column 3, line 54, delete "until the" and insert -- The --

Column 4, line 1, delete "A" and insert -- The --

Column 4, line 1, delete "is then"

Column 4, line 2, delete "applied to" and change "draw" to -- draws --

Column 4, line 16, after "4Q" insert -- , then energized, --

Column 4, line 1, delete "about 5 inches" and insert -- to an intermediate position --

Column 4, line 22, delete "The film frame is then raised against the oven as before:

UNITED STATES PATENT AND TRADEMARK OFFICE

CERTIFICATE OF CORRECTION

PATENT NO. : 4,575,991 Page 2 of 2

DATED : March 18, 1986

INVENTOR(S) : Alexander Hollingsworth

It is certified that error appears in the above-identified patent and that said Letters Patent is hereby corrected as shown below:

Column 4, line 23, delete "and the cycle of operations is repeated."

Column 4, line 30, change "packages" to -- packaged --

Signed and Sealed this

*Nineteenth* Day of *August 1986*

[SEAL]

*Attest:*

DONALD J. QUIGG

*Attesting Officer*

*Commissioner of Patents and Trademarks*